United States Patent [19]

Watts et al.

[11] 4,255,626

[45] Mar. 10, 1981

[54] MULTIPLE POSITION SWITCH

[75] Inventors: Roger E. Watts, Chicago; William W. Wright, Wheaton; William J. Donarski, Bellwood, all of Ill.

[73] Assignee: Guardian Electric Manufacturing Company, Chicago, Ill.

[21] Appl. No.: 65,096

[22] Filed: Aug. 9, 1979

[51] Int. Cl.[3] ..... H01H 19/00; H01H 19/06

[52] U.S. Cl. ..... 200/6 A; 200/153 K; 200/302

[58] Field of Search ..... 200/6 A, 6 R, 153 K, 200/302; 74/471 XY

[56] References Cited

U.S. PATENT DOCUMENTS

| | | | |
|---|---|---|---|
| 2,808,476 | 10/1957 | Elliott | 200/153 K |
| 2,849,548 | 8/1958 | Young | 200/6 A |
| 3,828,148 | 8/1974 | Roeser | 200/6 A |
| 3,898,397 | 8/1975 | Devore et al. | 200/302 X |
| 4,031,348 | 6/1977 | Eberhardt | 200/302 X |

*Primary Examiner*—J. V. Truhe
*Assistant Examiner*—Richard M. Moose
*Attorney, Agent, or Firm*—Allegretti, Newitt, Witcoff & McAndrews

[57] ABSTRACT

An improved four-way switch operated by a single manual push button at the end of a control column includes an axially extending shaft mounted to pivot on a stud. The shaft and stud are retained within a housing. An elastomeric washer with a frusto-conically shaped center passage is affixed on the shaft and engages the housing to radially bias the shaft and thereby maintain the shaft in proper axial alignment. Contacts are attached to the shaft and engage selected contacts on the housing when the shaft is pivoted. Guide slots in the housing cooperate with the pivotal shaft to control the direction of pivotal movement of the shaft.

8 Claims, 4 Drawing Figures

MULTIPLE POSITION SWITCH

BACKGROUND OF THE INVENTION

The present invention relates to an improved switch and more particularly to a multiple contact switch which is manually actuated in response to movement of a single shaft to any one of a number of switch contact positions.

In aircraft, such as helicopters, it is common to utilize a control stick with a manually operated four-way switch at the end. The manual control button associated with the switch may be moved up, down, right or left to thereby effect a desired control mode. In addition, the stick itself is movable to provide further control modes.

Heretofore numerous types of switches have been designed to provide a four-way switch action. Typical of such prior art switches are those shown in the following patents: Groves, U.S. Pat. No. 3,401,240 and Elliot, U.S. Pat. No. 2,808,476.

While the above noted patents disclose designs which are acceptable and workable as a four-way switch, the need for an improved, more efficient and more effective switch remains, particularly for use in aircraft control. One desirable characteristic in a four-way switch is improved snap action of the switch to center the control button associated with the switch upon manual release. Thus, when the button is released, it should automatically center or reposition itself at a neutral position and break control contact so as to discontinue the specific control mode. Additionally, a switch of simplified and rugged construction is a requisite. These are but some of the features desired and now provided by the present invention.

BRIEF DESCRIPTION OF THE INVENTION

Briefly, the present invention is a contact switch which includes a base with a projecting contact stud defining an axis. A shaft is mounted on the stud and projects in the axial direction. Contacts are attached to a plate projecting transversely from the shaft and are spaced radially from the axis. The shaft is pivotal on the stud in order to transport the contacts to make or break a circuit. A housing retains the shaft in position relative to the stud. A thumb control button is affixed to the end of the shaft. An annular elastomeric washer is positioned over the shaft and provides radial biasing forces to maintain the switch in a neutral, non-contact position. The elastomeric washer includes a center opening which is generally frusto conical and to facilitate the radial biasing action on the shaft.

It is thus an object of the present invention to provide an improved contact switch, particularly a switch which can provide a four-way switch action.

A further object of the present invention is to provide a contact switch which utilizes a new and simplified construction for providing radial biasing forces to maintain a contact support shaft in a generally neutral position.

Still another object of the present invention is to provide a contact switch which is of simplified construction, which is rugged and which is economical to manufacture.

These and other objects, advantages and features of the invention will be set forth in the detailed description which follows.

BRIEF DESCRIPTION OF THE DRAWING

In the detailed description which follows, reference will be made to the drawing comprised of the following figures.

DESCRIPTION OF THE PREFERRED EMBODIMENT

Figure 1:
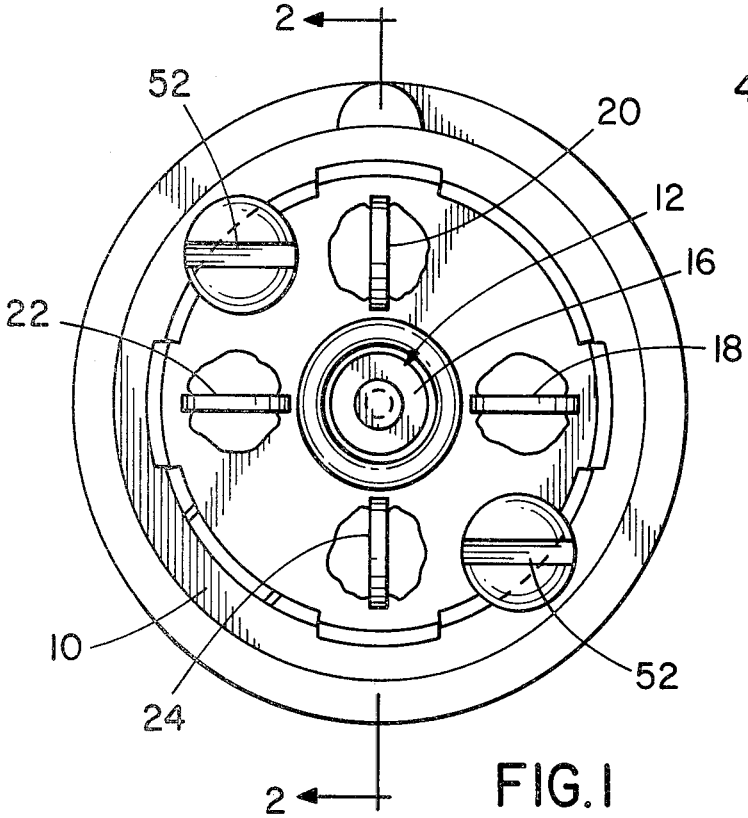
FIG. 1 is an end view of the base of the improved switch of the present invention.

The switch of the present invention is particularly adopted for use on a control stick for a helicopter or other aircraft. In an aircraft environment, the switch typically may be moved to any one of four positions in order to effect an up, down, right or left operation of the aircraft. Thus, the following description will be made in the context of a four-way switch. The invention, however, can be incorporated in a switch having one or more switch positions. Moreover, the invention is not limited to use in an aircraft environment.

Referring to the figures, the switch includes a base 10 molded from an insulating plastic material. A conductive center contact stud 12 is molded into the base 10. The stud 12 lies along and defines a center line axis 14 for the switch. The component parts of the switch are generally cylindrical with the axis 14 serving as an axis of revolution. The stud 12 includes an external connector 16.

The stud 12 is also surrounded by equally spaced contacts 18, 20, 22 and 24 molded in the base 10 and arranged at equal radial distances from the axis 14. Each contact 18, 20, 22 and 24 includes a contact surface 26.

Figure 3:
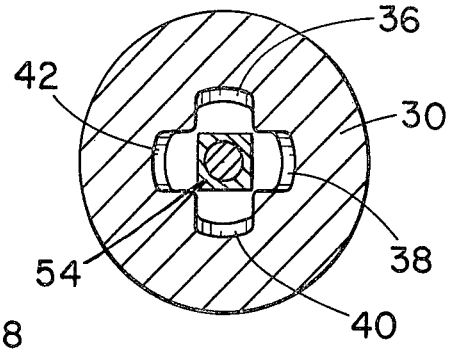
FIG. 3 is a side cross sectional view of the switch taken along the line 3—3 in FIG. 2.
Figure 4:
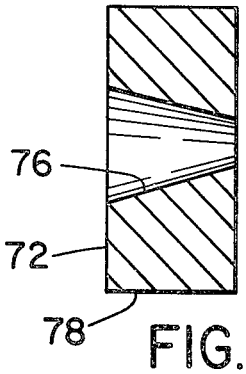
FIG. 4 is an enlarged side cross sectional view of the annular elastomeric washer used with the switch of the present invention prior to assembly of the washer upon the contact shaft of the switch.

The base 10 cooperates with a housing 30 and is positioned within a counterbore opening 28 of housing 30. The housing 30 is preferably fabricated from an insulating plastic material identical to that of the base 10. The opening 28 includes a first or major diameter bore 32 connected with a lesser diameter bore 34 and a series of four connected, parallel slots 36, 38, 40 and 42 as shown in FIG. 3. The slots 36, 38, 40 and 42 are equispaced and extend for an equal radial distance from the axis 14 in a cruciform. The slots 36, 38, 40, 42 each include an inclined wall 44 which generally forms an acute angle with the axis 14.

A ground terminal assembly 46 is positioned within the opening 32. The assembly 46 includes an annular washer 48 of conductive material with support legs 50 which project through base 10 and define ground connections 52.

A shaft 54 is mounted on stud 12 and projects along axis 14 through an opening 56 in washer 48. A spring 58 engages a flange 60 of shaft 54 and the washer 48 so as to bias the shaft 54 onto cylindrical head 62 of stud 12. The end of shaft 54 has a frusto conical bore 64 with side walls 66 and 68 positioned over head 62. The side walls 66 and 68 in combination with walls 44 for slots 36, 38, 40, 42 limit the pivotal movement of the shaft 54.

A contact retainer plate 66 is affixed to the shaft 54 and includes radially outwardly extending arms 68 with a contact 70 attached at the end of each arm 68. The contacts 70 are arranged in opposed relation with contacts 18, 20, 22 and 24 respectively. In this manner, upon pivoting movement of the shaft 54, an appropriate electrical connection will be made between a contact 70 and contact surface 26. A circuit will then be closed through the contacts and the ground 52. Alternatively the connector 16 of stud 12 may serve as the lead for closing a circuit.

The shaft 54 has a generally uniform, square cross section as illustrated in FIG. 3. An annular elastomeric or rubber washer 72 is fitted over the shaft 54 and is retained in the bore 34 between the washer 48 of the ground terminal assembly and an opposed surface 74 of counterbore 34. The axial dimension of the washer 72 is substantially equal to the distance between the surface 74 and the washer 48.

The elastomeric washer 72 has a special shape. That is, washer 72 includes a center passage 76 with a frusto conical shape. The narrow end of the frustrum is positioned away from the stud 12. Side surface 78 of washer 72 is a right circular cylindrical wall before the washer 72 is positioned on shaft 54. Positioning the washer 72 on shaft 54 causes the elastomeric washer 72 to be deformed so that the radial dimension of the washer 72 adjacent surface 74 is somewhat greater than the radial dimension adjacent the surface of washer 48. Thus, a larger gap exists between the side wall of bore 34 and surface 78 adjacent washer 48 than the gap adjacent surface 74.

A molded plastic button or thumb control knob 80 is molded onto a metal rod 81 which is threadably attached to the end of shaft 54. Note that the housing 30 has a convex end surface 82 which is compatible with the concave under surface 84 of knob 80. This permits ease of pivotal motion of the shaft 54 on the stud 12 in the appropriate slot 36, 38, 40 and 42.

Figure 2:
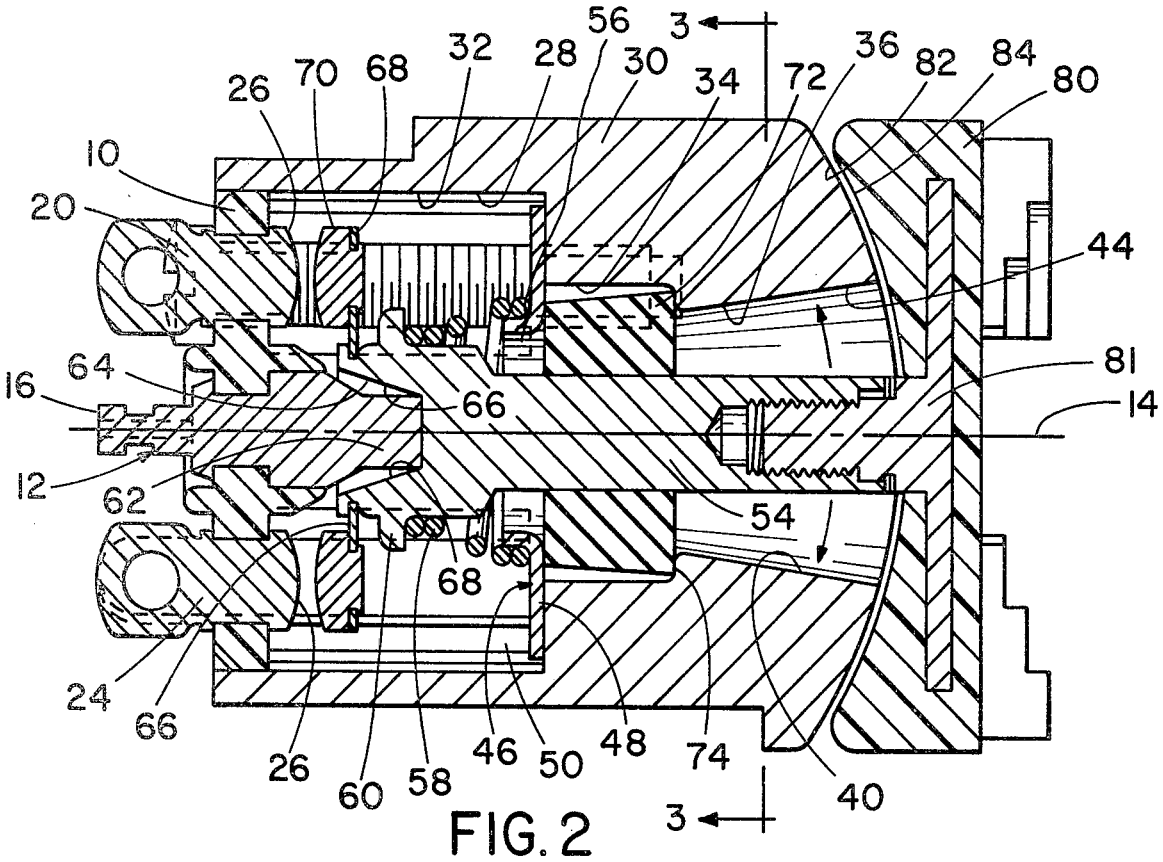
FIG. 2 is a side cross sectional view of the switch taken along the line 2—2 in FIG. 1.

Upon movement of the shaft in one of the slots 36, 38, 40 and 42, the elastomeric washer 72 is compressed. Simultaneously spring 58 is partially compressed. Release of manual tension on the knob 80 causes the washer 72 in combination with spring 58 to return the shaft 54 to the axial position shown in FIG. 2. The washer 72 also provides damping forces to eliminate chatter of the switch control and a more smooth switching operation.

It is possible to vary the described switch assembly and still remain within the scope of the invention. For example, the switch may be fabricated to provide one, two or more switching operations. Thus, while there has been set forth a preferred embodiment of the invention, it is to be understood that the invention is to be limited only by the following claims and their equivalents.

What is claimed is:

1. In a multiple contact switch of the type including a base with a center support and a pivot stud projecting therefrom, a separate shaft pivotally mounted on the stud and defining an axis, a housing mounted over the base and shaft, means for manually moving the shaft from axial alignment, at least one contact member attached to the shaft and spaced radially from the axis of the shaft for movement in response to pivoting movement of the shaft, said contact member cooperative with a fixed contact member upon sufficient pivotal movement of the shaft from axial alignment, the improvement comprising:

an annular elastomeric washer on the shaft cooperative with a recess in the housing to bias the shaft toward axial alignment, said elastomeric washer being positioned within a conical counterbore opening of the housing defining the recess, said washer defining a conical surface of lesser radial dimension than the conical surface of the counterbore within the housing whereby said surfaces are spaced during axial position of the shaft.

2. The improved switch of claim 1 wherein said shaft is generally uniform in cross section and said elastomeric washer has a frusto conical center opening fitted over the shaft which is elastically deformed by the shaft.

3. The improved switch of claim 2 wherein the frusto conical opening of the elastomeric washer has its narrow end opposite the pivot mounting of said shaft on said stud.

4. The improved switch of claim 1 wherein said housing includes a plurality of radially extending alignment slots to guide movement of said shaft and the attached contact to effect switching operation.

5. The improved switch of claim 1 wherein said shaft end opposite the stud includes a push button for manual actuation and movement of said shaft.

6. The improved switch of claim 1 wherein said shaft is axially biased into engagement with said stud by separate biasing means and is radially biased by the elastomeric washer.

7. The improved switch of claim 1 wherein at least a portion of said shaft has a polygonal shaped cross section for cooperation with the housing.

8. The improved switch of claim 1 wherein the end of the shaft positioned on the stud includes a frusto conical opening which receives the stud and wherein the sides of the frusto conical opening limit pivotal movement of the shaft on the stud.

* * * * *